United States Patent [19]

Sperber

[11] Patent Number: 4,766,749

[45] Date of Patent: Aug. 30, 1988

[54] LOCKING DEVICE

[76] Inventor: Alfred Sperber, 24 Reckendorfer Weg, D-8601 Gerach, Fed. Rep. of Germany

[21] Appl. No.: 910,400

[22] Filed: Sep. 22, 1986

[30] Foreign Application Priority Data

Sep. 27, 1985 [DE] Fed. Rep. of Germany ..... 3534448
Feb. 28, 1986 [DE] Fed. Rep. of Germany ..... 3606570

[51] Int. Cl.[4] ..... E05B 27/08

[52] U.S. Cl. ..... 70/491; 70/378; 70/419; 70/490

[58] Field of Search ..... 70/363, 376, 377, 378, 70/350, 351, 419, 362

[56] References Cited

U.S. PATENT DOCUMENTS

| | | | |
|---|---|---|---|
| 1,567,979 | 12/1925 | Northrop | 70/363 |
| 3,404,548 | 10/1968 | Keefer | 70/363 |
| 3,733,863 | 5/1973 | Toepfer | 70/363 |
| 4,064,720 | 12/1977 | Fry | 70/363 |

*Primary Examiner*—Robert L. Wolfe
*Attorney, Agent, or Firm*—Max Fogiel

[57] ABSTRACT

The invention concerns a locking device consisting of a key and of a lock. Inside the lock is a shaft (1) that has at least two diametrically opposed cams (4 & 5 ) mounted on it. The key can be positioned against one end (2) of the shaft in such a way that it cannot rotate in relation thereto. Inside the body (6) of the lock are blocking or barricading elements (9 & 10) that can slide or pivot radially in the unbarricaded state and that are subject to springs (40) that force them radially inward. The blocking elements are barricaded by means of several blocking pins (11) that block the sliding blocking elements or operate in conjunction with them by means of special blocking extensions on them to provide a blocking action. The blocking pins are subject to spring (12 or 60) that force them into the blocking position. Barricading is deactivated by means of tappets on the key that can be adjusted with respect to their effective length and that act either directly on the blocking pins or on intermediate complementary pins (27) and force them back. The locking device can also have means of blocking the blocking elements (9 & 10) in the outwardly displaced or pivoted position, the open position.

11 Claims, 9 Drawing Sheets

Figure 1:
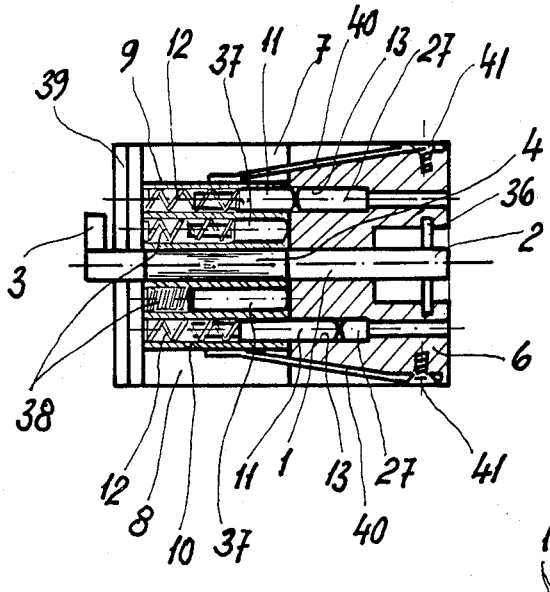

Fig. 6
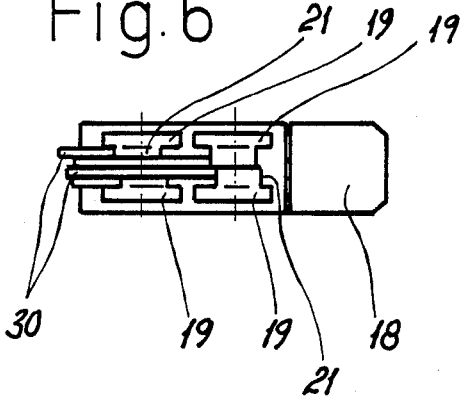
Fig. 7
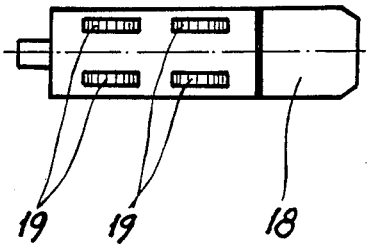
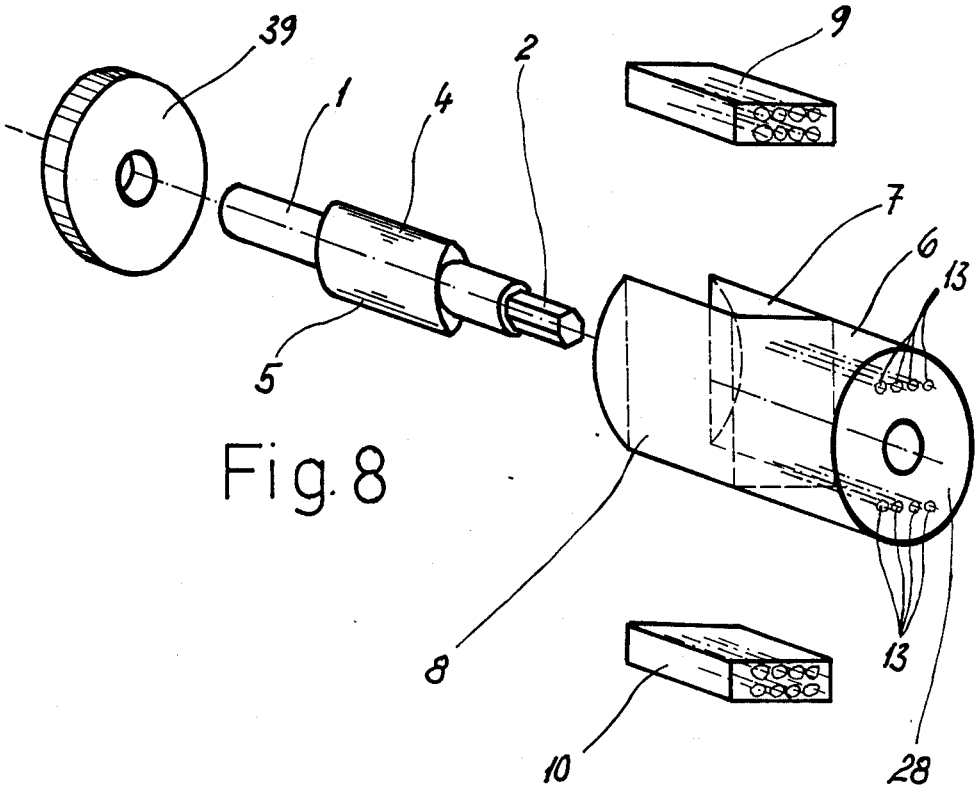
Fig. 8

LOCKING DEVICE

The invention concerns a locking device that consists of a lock and of a key.

Various types of locks with tumblers that can be activated and brought into the release position by an appropriately designed key are known. The shaft of the key is provided with various elevations and depressions or with an appropriate bit that acts on the tumblers. If the key gets lost and no replacement is available or obtainable, the lock will be worthless and must be replaced with another. Furthermore, since various types or lock are mounted on the different doors etc. that are to be locked, a large number of keys is necessary. Keyless locks called permutation locks, with a particular secret code in the form of a sequence of numbers that can be set by rotation, are also known. The lock can be opened once the code is known. These locks, however, are limited in application and often too unreliable to be employed everywhere. It is often possible for an expert to discover the secret code, by listening while turning the number rings for example.

The object of the invention is to create a locking device that consists of a lock and of a key and that can be employed anywhere in such a way that the authorized user will need only one key for all the locks while still ensuring that only the authorized user will be able to open the locks that are to be opened as well as that another user can undertake to open the locks or specific locks with the permission of the authorized user without studying and getting to known the total secret code. The locking device is intended to be compact in design and easy to manufacture, especially on an industrial scale. Its dimension are to be such that existing locking devices, cylinder locks already employed on the doors for example, can easily be replaced and refitted. The locking device is also intended for direct employment on motor vehicles for example, in the form of an ignition lock, a door lock, a luggage-compartment lock, etc., in such a way that the authorized user will require only one key.

This object is attained in accordance with the invention by means of the characteristics recited in the body of Claim 1. The claims following Claim 1 recite practical developments that advance the attainment of the object.

Thus, the locking device in accordance with the invention consists of a lock with at least two barricading or blocking elements that operate in conjunction with cams on a shaft accommodated in the lock. The blocking elements can be in the form of pistons or cassettes accommodated in passages in the body of the lock, sliding back and forth inside the passages when in the unbarricaded state and prevented from moving inside the shafts when in the barricaded or blocked state. The blocking elements are barricaded inside each passage into a radially inward position in which they more or less rest against the shaft in the vicinity of the base of the cams in such a way that the cams can prevent the shaft from rotating. The blocking elements can also be barricaded into a radially outward position inside each passage. In this position they are far enough out for the cams on the shaft to slide past them, and the shaft can accordingly be rotated. The shaft can also be rotated when the blocking elements are unbarricaded, with the cams forcing the unbarricaded blocking elements out when the shaft is turned. A particular secret code is assigned to each blocking element. Thus, two secret codes must be taken into consideration in one preferred embodiment of the invention wherein the shaft has two diametrically opposed blocking elements inside the body of the lock. These secret codes, which are set constant inside the lock, although they can be altered if necessary, can now be adjusted at the key, meaning that initially identically designed keys can be adapted by the authorized user to secret lock codes known to him.

Inside the cassette-like blocking elements in another embodiment of the invention are several blocking pins, graduated in length, that, subject to springs, constantly engage bores in the body of the lock in the blocked position and prevent the blocking elements from sliding. The key has matching tappets or mating pins that operate in conjunction with the blocking pins and have an effective length that can be adjusted in relation to the length of the blocking pins, with the differently graduated lengths of all the blocking pins providing the secret code of each blocking element, whereby the requisite code is maintained at the key. When the key is positioned, a rotating shaft gets connected in such a way that it cannot rotate to the shaft that the cams are mounted on inside the lock, and the mating pins on the key force, when correctly set, the blocking pins in the blocking elements into the release position, so that both the key shaft and hence the lock shaft can be turned. The actual locking element is mounted on the lock shaft, operating for example in conjunction with the lock's latch and displacing the latch out of the blocking and into the release position as the shaft of the lock is rotated. Complementary pins, also with matching lengths, are also associated in a practical way with each blocking pin.

In another practical embodiment of the invention the blocking pins can slide back and forth inside the body of the lock. The blocking elements are blocking or barricading plates that can be pivoted back and forth inside the body of the lock and are equipped with blocking extensions. The blocking extensions operate in conjunction with the blocking pins, which have an access opening that the blocking extensions on the blocking plates enter when the tappets on the key force the blocking pins into the unbarricaded position. This allows the blocking plates to pivot out into the unbarricaded position in which the shaft of the lock can rotate freely along with its cams.

The locking device in accordance with the invention can be employed wherever conventional locking mechanisms are used. The dimensions of the locking body or locking core allow the locking device to be employed very simply instead of conventional devices. Only one standard key is needed for all locks. Such a key can be purchased at gas stations for example, and then adapted to the user's own locks by adjusting the secret key code. The key is only slightly larger than a normal motor-vehicle key. One preferred embodiment of the invention is adjustable in 100,000,000 different ways. The key code can be set in a few seconds, even in complete darkness, because a ratcheting sound can be employed to follow the number of requisite adjustment steps. Since the lock has at least two independent secret codes, it is possible for example to provide an automobile for a friend who knows only one secret code and not the other. Once the key has been returned and the particular blocking element previously secured in the outer, blocking position has been unblocked, an unauthorized user will no longer be able to open the lock. The invention will also be practical in offices or shops. The employees can lock or unlock the locks in accordance with the invention employed therein during their working hours, whereas the employer will lock up at the end of the day and no one but him will be able to unlock the locks again. The secret codes themselves can neither be heard nor sensed even with electronic equipment. The lock is secure against drilling. The code can be changed at the lock if necessary by any expert as well as by technically accomplished laymen. Manufacturing costs are, especially on an industrial scale, relatively low and never higher than for conventional locking systems.

Figure 2:
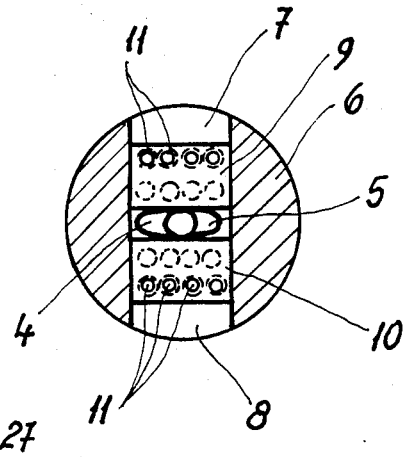
Figure 3:
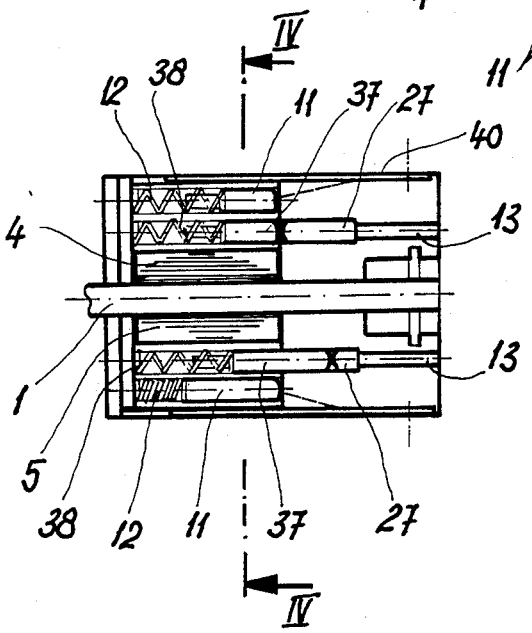
Figure 4:
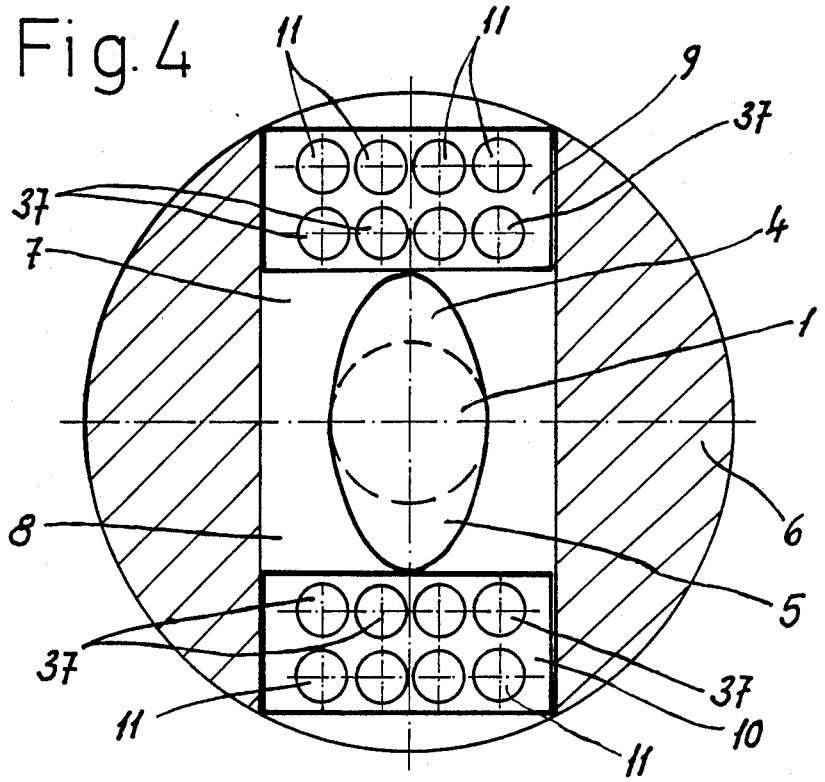
Figure 5:
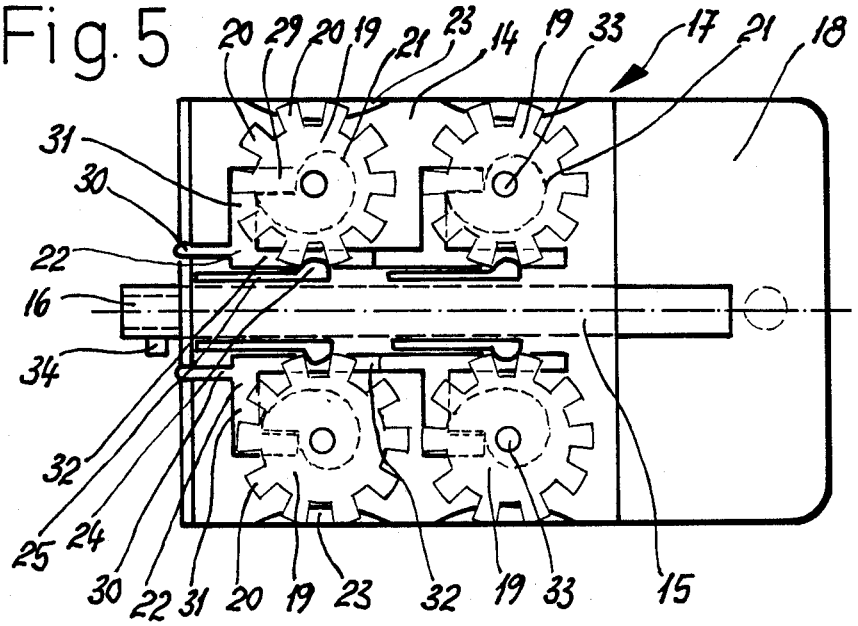
Figure 9:
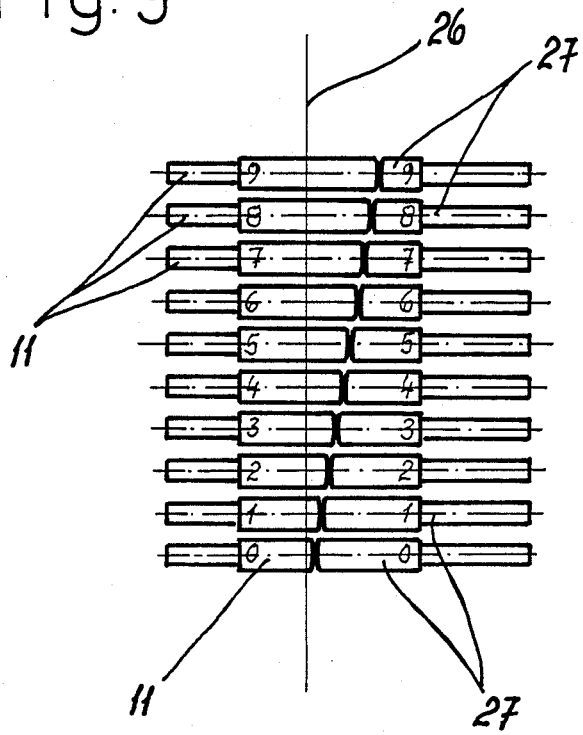
Figure 10:
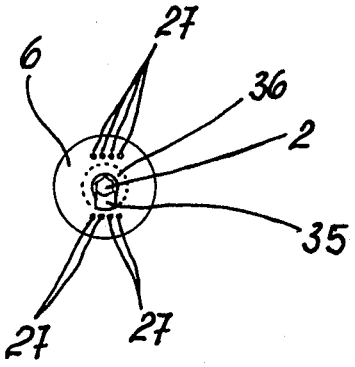
Figure 11:
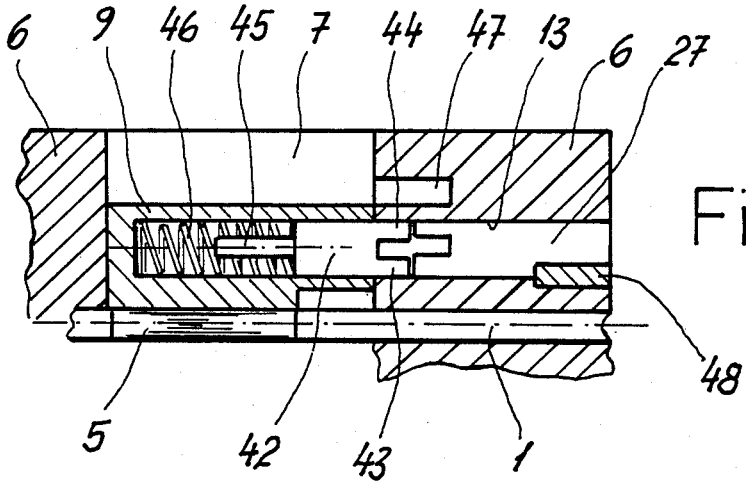
Figure 12:
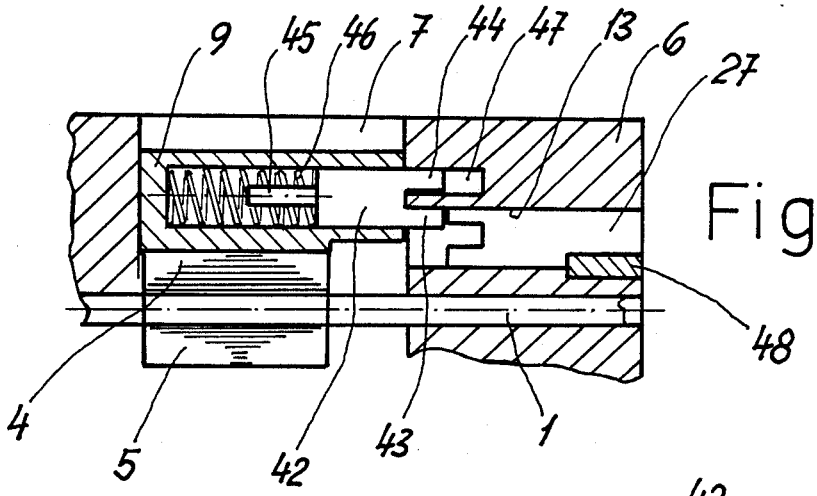
Figure 13:
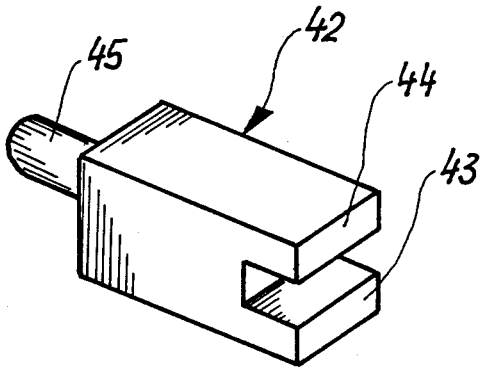
Figure 14:
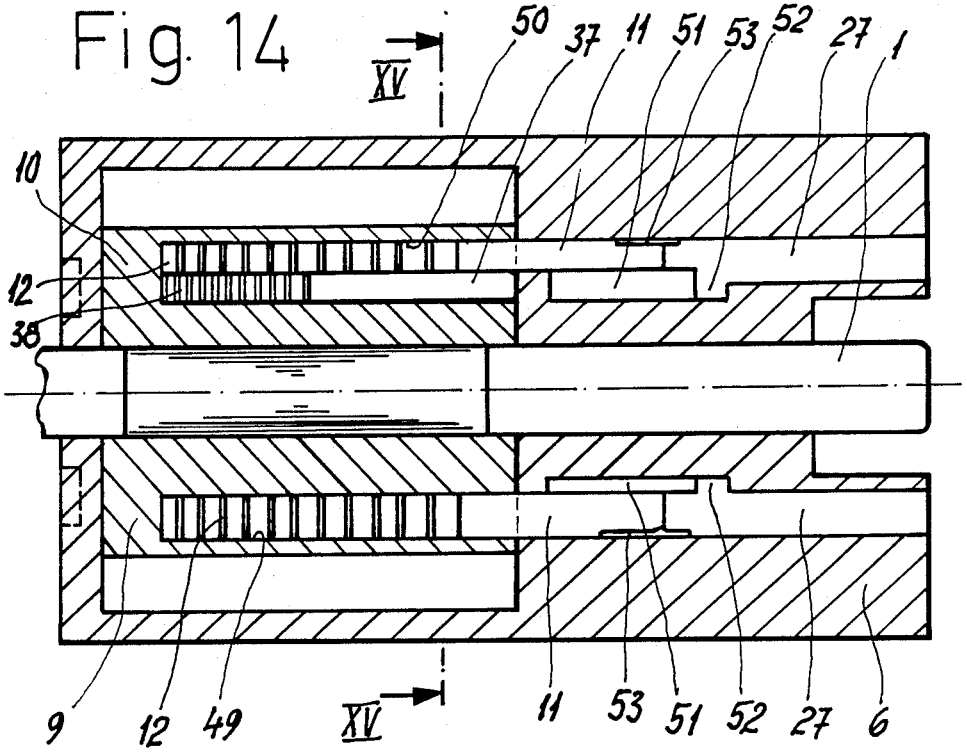
Figure 15:
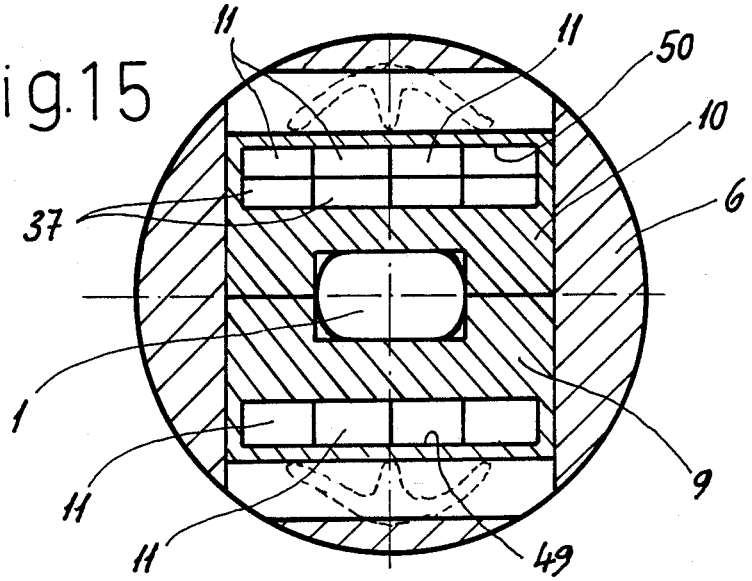
Figure 16:
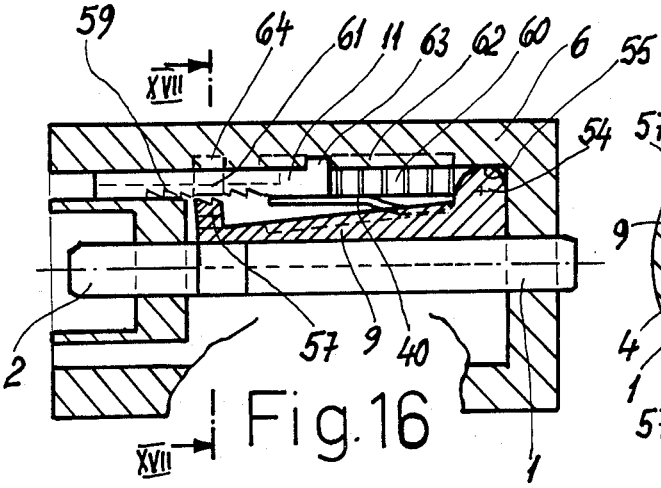
Figure 17:
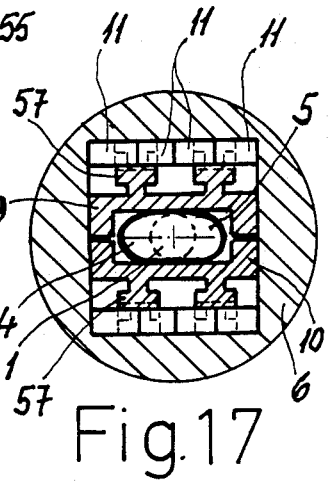
Figure 18:
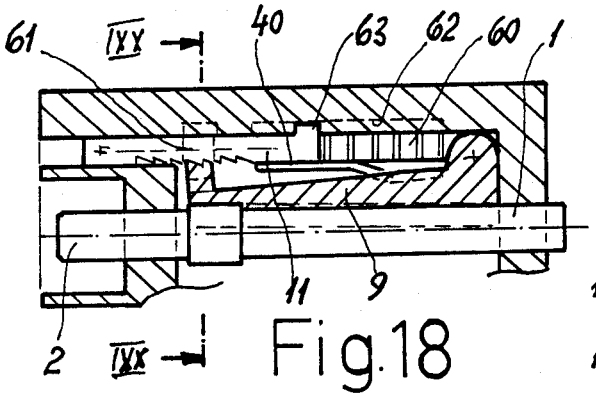
Figure 19:
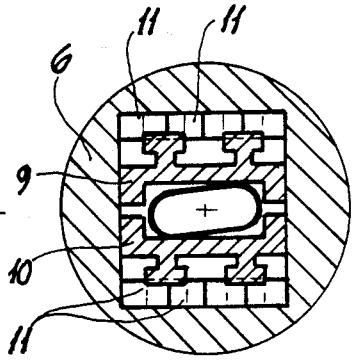
Figure 20:
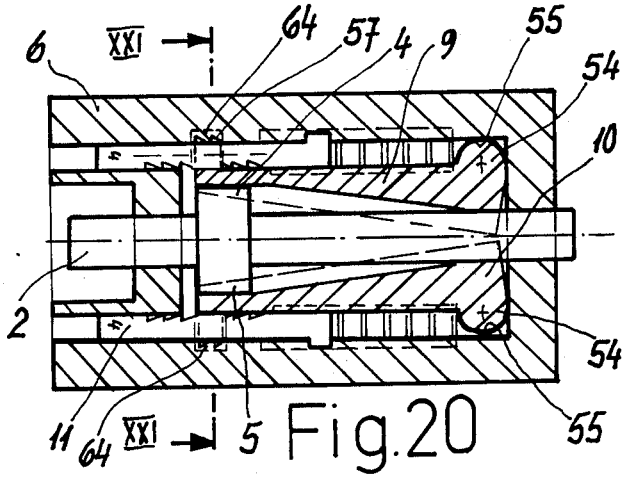
Figure 21:
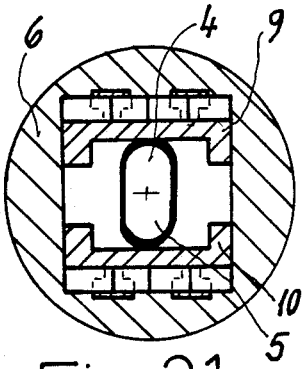
Figure 22:
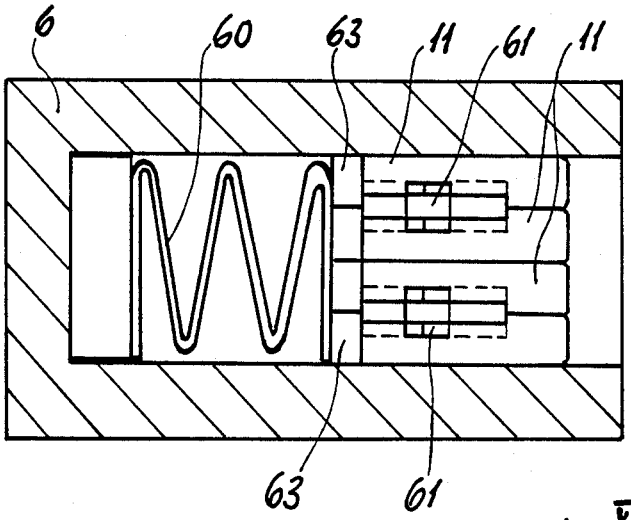
Figure 23:
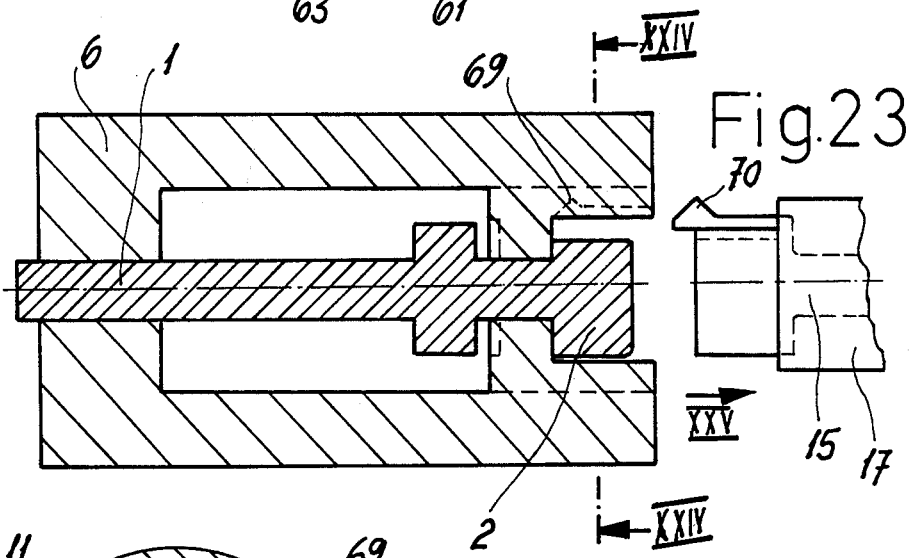
Figure 24:
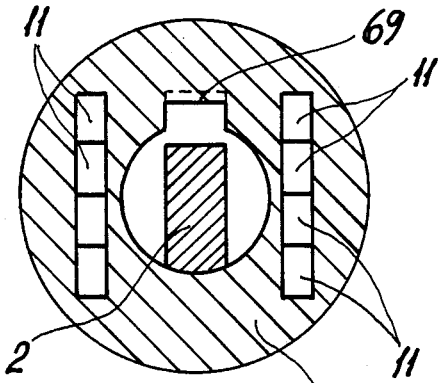
Figure 25:
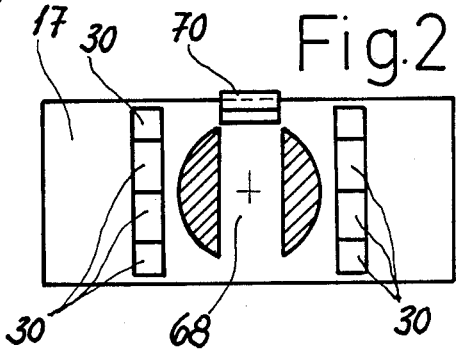
Figure 26:
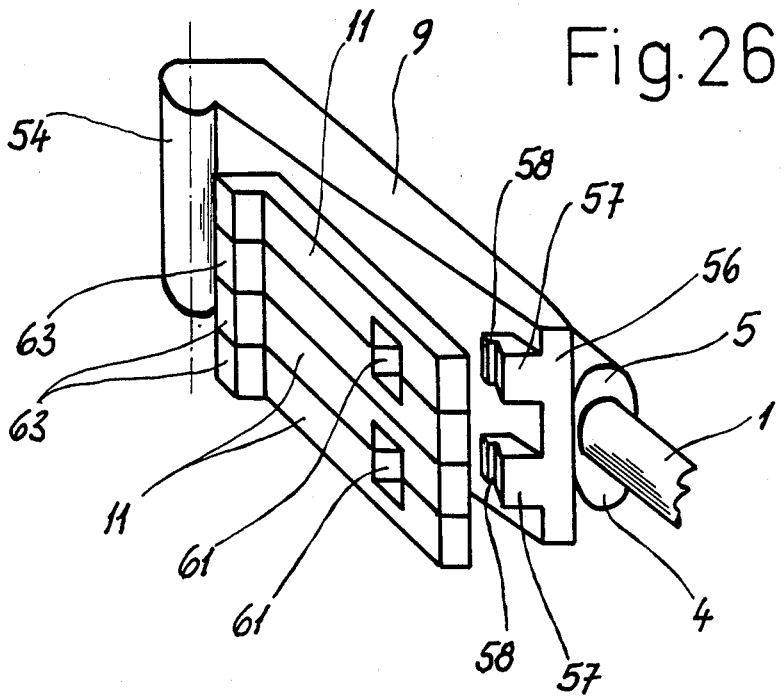
Figure 27:
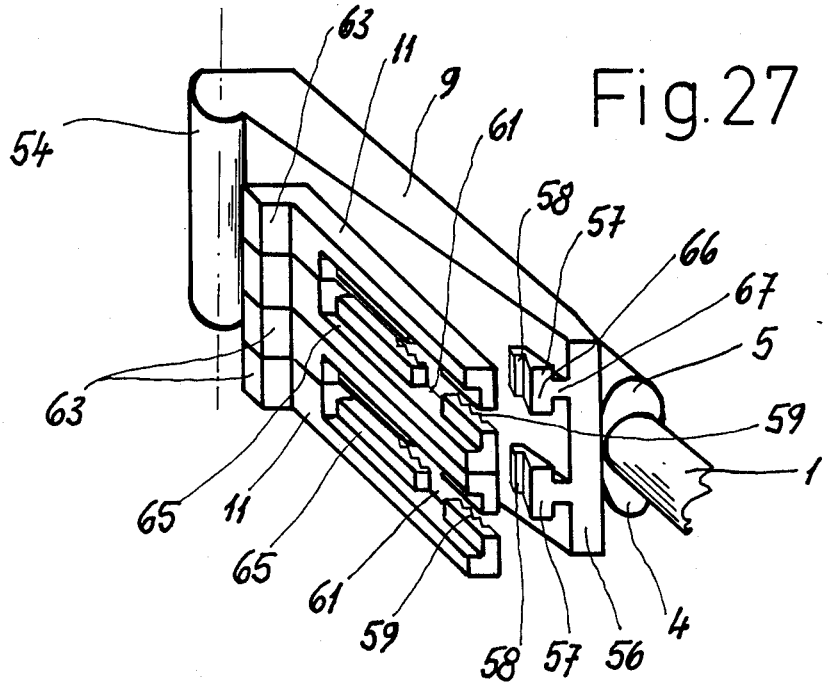

The invention will now be specified in relation to several embodiments and with reference to the drawings, wherein FIG. 1 is a schematic longitudinal section through a lock with two barricading or blocking elements in the form of cassettes in the blocking position, FIG. 2 is a front view of the lock in the direction indicated by arrow II in FIG. 1 showing the inside of the lock, FIG. 3 is a longitudinal section through the lock with both blocking elements unbarricaded and displaced outward, FIG. 4 is a highly magnified section through the lock along line IV—IV in FIG. 3, FIG. 5 is a schematic, large-scale, longitudinal section through the key associated with the lock, FIG. 6 is a schematic top view of the key showing the inside, FIG. 7 is a top view of the key showing the adjustment wheels on one side, FIG. 8 is an exploded perspective view of the lock, FIG. 9 is a large-scale schematic representation of all the available blocking pins and complementary pins that operate in conjunction with them, FIG. 10 is a front view of the lock in more or less its actual size, FIG. 11 is a schematic lateral cutaway view of one half of another embodiment of the invention with the shaft in the blocked state (lock locked), FIG. 12 is a lateral view of the half of the lock with the shaft able to rotate freely due to the blocking or barricading elements being secured radially outward, FIG. 13 is a large-scale perspective view of the one-piece blocking unit consisting of a blocking and of a retaining component, FIG. 14 is a large-scale longitudinal section through another variant of the locking device, FIG. 15 is a section along line XV—XV in FIG. 14, FIG. 16 is a schematic, large-scale longitudinal section through another embodiment of the locking device with pivoting barricading or blocking elements in the barricading position, FIG. 17 is a section through the locking device section along line XVII—XVII in FIG. 16, FIG. 18 shows the locking device with the blocking elements slightly pivoted and blocked, FIG. 19 is a section along line IXX—IXX in FIG. 18, FIG. 20 shows the locking device with the blocking elements pivoted into the unbarricaded position, FIG. 21 is a section through the locking device along line XXI—XXI in FIG. 20, FIG. 22 is a schematic longitudinal section through the locking mechanism in the vicinity of the blocking pins, FIG. 23 is a schematic section through the locking device with the key just about to be positioned, FIG. 24 is a section through the locking device along line XXIV—XXIV in FIG. 23, FIG. 25 is a front view of the key from the direction indicated by arrow XXV—XXV in FIG. 23, FIG. 26 is a perspective view of a pivoting locking or blocking element with blocking pins, and FIG. 27 is a perspective view of a variant of the blocking element that can be stopped in the unbarricaded position.

The locking device consists of the lock itself and of the associated key, which can at any time be adapted to the lock. FIGS. 1 and 2 illustrate the lock in the barricaded state. The design of the lock will also be evident from FIG. 8. The body 6 of the lock is cylindrical and of dimensions that allow it to replace a conventional cylindrical lock without any problems. As will be evident from the longitudinal sections in FIGS. 1 and 8, a shaft 1 extends through the center of the body with one end 2 in the shape of a hexagon for example and with a locking element 3, which acts for example on an unillustrated bolt, secured non-rotating to its other end. As will be evident from FIG. 2 as well, two cams 4 and 5 are mounted diametrically opposite each other on shaft 1. Two passages 7 and 8, as wide axially as one of cams 4 and 5 is long, have been left in lock body 6 in the vicinity of the cams. Two barricading or blocking elements 9 and 10 fit inside passages 7 and 8. Passages 7 and 8 extend radially, constituting a single continuous passage transversed by shaft 1. Blocking elements 9 and 10 are, depending on the cross-section of passages 7 and 8, in the form of pistons or cassettes and contain several, four in the present case, adjacent blocking pins 11, which coaxially positioned compression springs 12 are associated with and which the springs tend to force into bores 13 in lock body 6 and to retain them there, securing blocking elements 9 and 10 in a radially inner position as illustrated in FIGS. 1 and 2. In this blocked state, shaft 1 cannot be rotated because cams 4 and 5 are secured and tensioned between blocking elements 9 and 10.

Blocking pins 11 are of various lengths, meaning that the lengths of two adjacent pins in one row can differ. There is a total of ten blocking pins 11 and hence a total of ten graduated lengths (cf. also FIG. 9). What is essential is the length along which blocking pins 11 extend from passage 7 or 8 into the bores 13 in lock body 6 (FIG. 9 illustrating the line 26 of separation between passages 7 and 8 and the mouths of bores 13). The shortest length can be 0.3 mm (that of the lowest blocking pin 0 in FIG. 9) and the longest length 3.0 mm (the uppermost blocking pin 9), at a graduation or increment of 0.3 mm. The secret code for each blocking element 9 and 10 is accordingly provided by the number of blocking pins, four in this case, of different lengths. Thus, each row of blocking pins represents a four-place secret code, with each place being capable of ten pcrmutations. Since the code for each blocking element 9 or 10 can be independently set by positioning an appropriately graduated blocking pin 11, the secret code can have 100,000, 000 variations. With each blocking pin 11 is associated a complementary pin 27 inside bores 13. Bores 13 initially, beginning at passages 7 and 8, have a long diameter, equalling that of the section of blocking pins 11 that enters them. This diameter decreases outwardly. The end of complementary pins 27 that points outward also has a shorter diameter. Since the thicker section of each complementary pin 27 is as long as the thicker section of its associated blocking pin 11, the total of the lengths of each blocking and complementary pin is always constant. The complementary pins 27 in bores 13 are in alignment with the face 28 of lock body 6.

Shaft 1 cannot be turned until blocking elements 9 and 10 are unbarricaded and can slide freely back and forth in passages 7 and 8. Blocking elements 9 and 10 can be unbarricaded with a specially designed key, illustrated in FIGS. 5 through 7. Key 17 consists essentially of a bolt 15 that rotates in key body 14. The projecting end 16 of the bolt is shaped like the end 2 of shaft 1. Thus, positioning key 17 results in a non-rotating coupling between bolt 15 and shaft 1. Secured non-rotating to the other other end of bolt 15 is a grip 18. Inside key body 14, four adjusting wheels 19 rotate on each side. Distributed around each wheel are elevations or teeth 20. Each wheel also has helical supporting surface 21. A tappet or mating pin 22 rests against each supporting surface 21 and operates in conjunction with the blocking pins 11 in the lock through the complementary pins 27 associated with the blocking pins. Tappets or mating pins 22 consist of an inner tappet 29, with a free end resting against a helical supporting surface 21, and of an outer tappet 30 that extends outward and is attached to inner tappet 29 by means of a web 31. Each mating pin 22 also has a relatively long guide component 32.

In the setting illustrated in FIG. 5, all the adjusting wheels 19, which are mounted on shafts 33, are in a position in which inner tappets 29 rest against the radially most retracted section of a helical supporting surface 21, meaning that mating pins 22 are at their shortest effective length and are retracted as far as possible into key body 14. With adjusting wheels 19 in this zero setting, outer tappet 30 extends out of key body 14 over the first of the ten graduations. There are depressions 23 on the outer surface of key body 14 and in the vicinity of adjusting wheels 19 to allow the wheels to be accessed and adjusted, turned that is, with the fingers. Rotating an adjusting wheel 19 one position will vary the effective length of the mating pin 22 by one graduation (0.3 mm).

The thicker end 24 of a spring 25 engages between each pair of teeth 20 on adjusting wheels 19, acting like a ratchet and allowing the wheels two turn in both directions. When a wheel rotates one position, the rise and fall of ratchet spring 25 produces a sound that indicates to the user even in the dark how many steps he has adjusted the wheel and accordingly how far out he has displaced outer tapet 30. The adjusting wheels 19 in FIG. 6 are at different settings, and each associated outer tappet 30 extends out of the body of the lock to a different distance that corresponds to the secret code. The code of the other blocking element 10 is set with the lower four adjusting wheels 19. Since ten different settings are possible, ten teeth 20 and an equal number of gashes for the thicker end 24 of ratchet spring 25 to drop into are distributed around each wheel.

A nose 34 is positioned on the projecting end 16 of rotating bolt 15. When projecting end 16 is inserted onto the end 2 of shaft 1, nose 34 passes through a matching recess 35 (cf. FIG. 10) and engages a continuous groove 36 (also evident in FIG. 1). Thus, key 17 will be securely attached to the lock once it has been placed against it and rotated.

As previously specified, each blocking element 9 and 10 has several adjacent blocking pins 11 of different lengths in accordance with the secret code. Associated with each blocking pin 11 is an identical retaining pin 37, also subject to a compression spring 38 that tends to force the retaining pin 37 toward bores 13. Retaining pins 37 are also positioned one next to another in a row. The row of retaining pins 37 is radially farther in and nearer the axis, or nearer shaft 1. Thus each blocking element 9 and 10 has pairs of blocking pins 11 and of retaining pins 37, each pair having identical pins.

The function and operation of the locking device will now be briefly specified.

The authorized user, knowing the secret code for both blocking elements 9 and 10, sets the code by approriately rotating the adjusting wheels 19 on key 17. When key 17 is positioned against the lock or, more precisely, when the projecting end 16 of the bolt 15 in key 17 is positioned against the end 2 of shaft 1, outer tappets 30 enter the bores 13 in lock body 6 just far enough to displace complementary pins 27 and hence blocking pins 11 against the force of compression springs 12 until the free end of blocking pins 11 comes into alignment with line 26 of separation and hence with the wall of passages 7 and 8. In this position both blocking element 9 and blocking element 10 are unbarricaded, and both elements can slide freely back and forth in passages 7 and 8. Thus, key shaft 15 can be turned by means of grip 18 because lock shaft 1 is unblocked. When the shaft is turned, cams 4 and 5 force blocking elements 9 and 10 radially outward, and the elements arrive in the position illustrated in FIGS. 3 and 4. The rotation of shaft 1 also entrains locking element 3, which acts on the actual locking mechanism itself.

In the position illustrated in FIGS. 3 and 4, in which blocking elements 9 and 10 are radially outward, the retaining pins 37 of blocking elements 9 and 10 are coaxial with complementary pins 27. If the user now desires to block at least one blocking element 9 or 10 in this position, he has only to turn one of the adjusting wheels 19 in key 17, retracting the associated outer outer tappet 30, so that the associated retaining pin 37 will enter a bore 13 and detain blocking element 9 or 10 in that position. With both blocking elements 9 and 10 detained in the radially outward position, anyone can open the lock. It is unlocked and can be freely rotated. If only one blocking element is barricaded in the outer position as is the case with blocking element 10 in FIG. 3, the secret code for blocking element 9 will still be needed to open the lock. Another person will, with permission from the authorized user, accordingly know only the one code and not that of the detained blocking element. When the code for the detained blocking element is set again at the key, the blocking element will be able to slide freely again and will slide into its inner position, in which it will be detained again once the key has been withdrawn.

The lock is compactly designed, and its dimensions (the lock is substantially illustrated in its actual size in FIG. 10) allow it to replace a conventional cylindrical lock. It should also be remarked with reference to FIG. 8 that a closure disk 39 is added once the individual components of the lock have been assembled. Blocking elements 9 and 10 are displaced inward in the unbarricaded state by springs 40 secured with screws 41 to lock body 6 and with their free end resting against the blocking elements. Springs 40 are leaf springs.

If even one adjusting wheel 19 on key 17 is incorrectly adjusted, it will be impossible to unblock blocking elements 9 and 10. If, for example, one outer tappet 30 does not extend far enough out of the body of the key, the corresponding intermediate or complementary pin 27 will not be displaced far enough and hence the associated blocking pin 11 not completely retracted, so that it will continue to extend into bore 13. If an outer tappet 30 extends too far forward, the intermediate or complementary pins 27 will be advanced too far, extending into the bore in blocking element 9 or 10 that accommodates the associated blocking pin 11, and keeping the blocking element detained. It is also impossible to drill bores 13 out from outside because the intermediate pin will travel along. The locking device is accordingly secure both against being broken into and in function.

The adjusting wheels 19 on key 17 can also be activated for example with small step motors, by a system of pushbuttons and time relays, and, if necessary, digitally.

Another embodiment of the invention is illustrated in FIGS. 11 and 12, which show only one half of lock body 6, the other half being extensive symmetrical. Inside the barricading or blocking elements 9 and 10 (only element 9 being illustrated) that slide back and forth in passages 7 are several adjacent (in a row perpendicular to the plane of the drawing) blocking units 42, each consisting of an integrated blocking pin and retaining pin. As will be especially evident from FIG. 3, blocking units 42 are shaped more or less like blocks, meaning that they have a rectangular cross-section. One end is more or less bifurcated. It consists of two tines 43 and 44, representing a blocking pin 11 (or, better expressed, blocking component) and a retaining pin 37 (or retaining component). Projecting from the other end of blocking unit 42 is a centering bolt 45. The function of bolt 45 is to center a compression spring 46 that tends to force the associated blocking unit 42 out of barricading element 9 or displace it outward. Inside lock body 6 are complementary or intermediate pins 27 of graduated lengths that operate in conjunction with the also graduated tines 43 and 44 on bifurcated blocking units 42. Intermediate pins 27, which also have a rectangular cross-section, are displaced longitudinally by the adjustable tappets 30 on key 17 (cf. FIG. 5), also displacing the locking blocks or blocking units 42 in against the force of compression spring 46. With the blocking elements 9 in the position illustrated in FIG. 11, the bifurcated ends of spring-loaded blocking units 42 extend into the bores 13 that accommodate intermediate pins 27 and accordingly retain blocking elements 9 radially inward in the illustrated position. It is impossible to turn lock shaft 1 and hence open the lock because the cams 4 and 5 on shaft 1 rest against blocking units 42, which are prevented from being displaced radially outward inside passage 7. When key 17 is positioned against shaft 1, the tappets 30 in key 17, which match the length of intermediate pins 27, specifically because the authorized person with knowledge of the secret code has appropriately adjusted their effective length, engage bores 13 and displace intermediate pins 27 and hence blocking units 42 until the bifurcated ends of the units emerge from bores or perforations 13. Barring or blocking elements 9 will then be able to slide freely and will be displaced radially outward by cams 4 and 5 if shaft 1 is turned. In the body 1 of the lock are recesses 47 with dimensions that match those of tine 44. When the tappet 30 on key 17 is rotated back, tines 44 will, subject to springs 46, enter recesses 47 and, if desired, detain blocking element 9 in the radially outward position, to prevent discovery of the secret code by an unauthorized person, whereas the other secret code is freely available. When a key 17 adjusted to the secret code is inserted again, tines 44 will exit recesses 47 and the springs will force barricading elements 9 radially inward until the blocking units enter perforations 13 and block the mechanism. The temporary and provisional user can accordingly no longer activate the lock, and only the authorized user can do so.

To make it even more difficult or even impossible to drill the locking device open, a plate 48 of hardened steel is embedded in the vicinity of bores or perforations 13.

The block-shaped blocking units 42 can of course also have a different shape, a round cross-section for instance. The one-piece design for the blocking and retaining component results on the whole in compact units with a relatively large cross-section that can withstand even more powerful shearing forces. Since only one spring 46 is necessary for each blocking unit 42, the spring can have a relatively long diameter, also providing powerful spring forces to reliably detain blocking units 42 in blocking bore 13 or retaining bore 47.

Whereas the locking device illustrated in FIGS. 1 through 4 has blocking pins 11 and retaining pins 37 with a circular cross-section accommodated in similarly shaped bores in blocking elements 9 and 10, FIGS. 14 and 15 illustrate a locking device with blocking and retaining pins 11 and 37 that have a rectangular cross-section. Blocking and retaining pins 11 and 37 are accommodated one on top of or one next to another in a single recess 49 or 50. Only one of the two blocking elements 9 and 10, specifically blocking element 10, has both blocking pins 11 and retaining pins 37, whereas element 9 has only blocking pins 11. Thus, only barricading element 10 can be detained in the radially outward open position. Intermediate pins 27, which act on blocking pins 11 and retaining pins 37 through tappets 30, have a projection 52 that slides back and forth in a recess 51. The springs 12 associated with blocking pins 11 and the springs 38 associated with retaining pins 37 are corrugated springs. Blocking pins 11 can have a dissimulation step 53 of a different length to reliably prevent solving the secret code through the sense of touch by material stress due to turning shaft 1.

Finally, FIGS. 16 through 27 illustrate another preferred embodiment of the locking device in which the barricading or blocking elements 9 and 10 are not cassettes or pistons that slide back and forth in passages but blocking plates that pivot inside lock body 6. One edge 54 of each blocking plate 9 or 10 (cf. also FIGS. 26 and 27) is thicker and has a circular cross-section. Thicker edge 54 rests in a matching recess 55 in lock body 6 and constitutes a pivoting axis for blocking plates 9 and 10. Blocking pins or blocking extensions 57 are positioned near the other edge 56 at the side facing away from lock shaft 1 with its cams 4 and 5. Blocking extensions 57 have graduations or teeth 58 that correspond to graduations or teeth 59 on the blocking pins 11, which are subject to a corrugated spring 60 and can slide back and forth longitudinally. There are perforations 61 in blocking pins 11, with each pair of adjacent blocking pins 11 having a perforation large enough for blocking extensions 57 to extend through once the pins have been shifted into the correct position by the tappets 30 in key 17. Key 17 is positioned against the end 2 of shaft 1. The end of each blocking pin 11 that faces corrugated spring 60 has stops 63 that slide back and forth in recesses 62 in lock body 6. A leaf spring 40 rests against each blocking element 9 and 10 and maintains it radially inward as illustrated in FIGS. 16 and 17. FIGS. 16, 18, and 20 illustrate blocking pins 11 in a position in which perforations 61 allow penetration of blocking extensions 57 and hence the pivoting out of blocking elements 9 and 10. Blocking plates 9 and 10 can pivot and the lock can accordingly be opened only when perforations 61 are at the same level as blocking extensions 57. When lock shaft 1 is turned, cams 4 and 5 will rest against the inside of blocking elements 9 and 10. When blocking pins 11 are in the blocking position, when, that is, perforations 61 are not in alignment with blocking extensions 57, the graduations or teeth 58 on blocking extensions 57 will engage the teeth 59 on blocking pins 11 (cf. FIGS. 18 & 19). It is then impossible for blocking plates 9 and 10 to continue to pivot or for blocking pins 11 to slide. When, however, perforations 61 are aligned with blocking extensions 57, the extensions can project through the perforations until blocking plates 9 and 10 arrive at their outward and open position (cf. FIGS. 20 & 21). For this purpose there are additional recesses 64 in lock body 6 to provide access for the free ends of blocking extensions 57.

The locking device illustrated in FIGS. 16 through 21 employs blocking plates 9 and 10 like those in the embodiment illustrated in FIG. 27. Blocking plates 9 and 10 have groove-shaped and undercut recesses 65. Blocking extensions 57 are also undercut, meaning that they have a wide heads 66 and a narrower base 67. Once the heads 66 of blocking extensions 57 have passed through perforations 61, blocking pins 11 can be displaced again and, in the displaced position, retain blocking plates 9 and 10 in the open position, with the heads 66 of blocking extensions 57 resting against the bottom of the recesses 65 in blocking pins 11. Thus, no special retaining pins are needed in this embodiment.

FIG. 26 illustrates an especially compact design in which blocking pins 11 lack the groove-like recesses 65. Blocking extensions 57 are also of constant width throughout. With this version of blocking pins 11 and of blocking extensions 57 it is impossible for blocking plates 9 and 10 to remain in the open position. The blocking plate 9 and blocking pins 11 can be like those illustrated in FIG. 26 for instance and the other blocking plate 10 and its associated blocking pins 11 in the same locking device be like those illustrated in FIG. 27, so that one blocking plate will remain in the open position and the other not. FIGS. 26 and 27 by the way show the blocking plates 9 in the closed position, and blocking pins 11 have a rectangular cross-section.

FIGS. 23 through 25 also illustrate a practical embodiment of key 17 and of the vicinity of the coupling between the lock and the key. Shaft end 2 is flattened, and the end of key shaft 15 has a matching slot for shaft end 2 to interlock with when key 17 is positioned. There is a recess 69 at the entrance to the locking device that is engaged by a radially resilient coupling projection 70 when key 17 is in position. Projection 70 secures the key to the locking device when key shaft 15 and lock shaft 1 are rotated.

It should also be remarked that the axes that blocking plates 9 and 10 pivot around are perpendicular to the longitudinal central axis of lock shaft 1 and that blocking plates 9 and 10 pivot outward, so that it is impossible for anyone to detect the correct code by the sense of touch when the blocking plates are in the blocked state.

I claim:

1. A locking device comprising: a lock and a key; a shaft in said lock and blocked in a closed state of said lock, said shaft having an outer end, said key being positioned non-rotating against said outer end; at least two diametrically opposed cams and blocking elements, said cams operating in an unblocked position and in conjuction with said blocking elements, said blocking elements being slidable or pivotable radially outward by turning said shaft, a predetermined secret code independent of another code and setable at the key is associated with each blocking element; said blocking elements comprising two blocking plates pivoting inside said lock and resiliently forced inward; said blocking plates having blocking extensions mounted on the outside; and blocking pins secured inside said lock and having perforations entered by said blocking extensions when said blocking pins are in an unblocked position and when said shaft is turned.

2. A locking device as defined in claim 1, wherein said key has a rotating bolt with a free end positionable against an end of said shaft so that said bolt cannot rotate in relation to said shaft, said bolt having another end with a grip that cannot rotate in relation to said bolt.

3. A locking device as defined in claim 1, including pins secured to said lock and slidable back and forth therein; a helical supporting surface mounted on adjusting wheels, said pins resting against said helical supporting surface, said helical supporting surface being rotatable while an associated pin is correspondingly displaced and adjusted in effective length of said pin.

4. A locking device as defined in claim 3, including spring means functioning as a ratchet and associated with each adjusting wheel and allowing the wheel to be turned in both directions, said wheel being setable manually or by a motor, said spring means having a thicker end resting resiliently against the associated wheel.

5. A locking device as defined in claim 1, including tappets and a helical supporting surface, one of said tappets comprising an inner tappet resting against said helical supporting surface, another one of said tappets comprising an outer tappet resting against an associated complementary pin when said key is positioned; and a web connecting said inner and outer tappets.

6. A locking device as defined in claim 1, wherein said blocking plates have an edge with an annular thickening in cross-section and comprising a pivoting axis perpendicular to an longitudinal central axis of said shaft; and spring means acting on said blocking pins.

7. A locking device as defined in claim 6, wherein said blocking pins have a rectangular cross-section and have detent teeth at an end facing said blocking plates; said blocking extensions having detent teeth engaging and detainng said blocking pins in a blocked position.

8. A locking device as defined in claim 6, including spring means common to all blocking pins, said blocking pins having stops at end facing said spring means common to all blocking pins, said stops sliding back and forth in a recess in said lock.

9. A locking device as defined in claim 1, wherein said blocking extensions are undercut, said blocking extensions engaging behind a groove-shaped offset recess in said blocking pins and detaining each blocking plate in an open position after said blocking extensions have traveled through said perforations in said blocking pins.

10. A locking device as defined in claim 1, wherein said lock has groove positioned in vicinity of a free end of said shaft; a projection on a key bolt engaging said groove when said key is positioned.

11. A locking device as defined in claim 10, wherein said projection comprises a radially resilient coupling projection.

* * * * *